US008070519B2

(12) United States Patent
Lin et al.

(10) Patent No.: US 8,070,519 B2
(45) Date of Patent: Dec. 6, 2011

(54) ELECTRICAL CONNECTOR INCORPORATED WITH SIGNAL CONTROLLING CIRCUITRY

(75) Inventors: Wei-Chung Lin, Tu-Cheng (TW); Jui-Kuang Chung, Tu-Cheng (TW); Chih-Nan Lin, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 46 days.

(21) Appl. No.: 12/753,314

(22) Filed: Apr. 2, 2010

(65) Prior Publication Data

US 2010/0255702 A1 Oct. 7, 2010

(30) Foreign Application Priority Data

Apr. 3, 2009 (TW) ..... 98205424 U

(51) Int. Cl.
*H01R 13/66* (2006.01)

(52) U.S. Cl. ..... 439/620.24; 439/222; 439/941

(58) Field of Classification Search ..... 439/222, 439/620.15, 620.16, 620.21, 620.24, 941
See application file for complete search history.

(56) References Cited

U.S. PATENT DOCUMENTS

| | | | | |
|---|---|---|---|---|
| 6,902,433 | B1 * | 6/2005 | Hashimoto et al. | 439/620.15 |
| 7,121,893 | B2 * | 10/2006 | Broghammer et al. | 439/620.24 |
| 7,322,860 | B2 * | 1/2008 | Martich et al. | 439/676 |
| 7,413,477 | B2 * | 8/2008 | Autio et al. | 439/668 |
| 7,540,747 | B2 * | 6/2009 | Ice et al. | 439/79 |
| 7,572,149 | B2 * | 8/2009 | Matsuura et al. | 439/620.21 |
| 2010/0255702 | A1 * | 10/2010 | Lin et al. | 439/218 |

FOREIGN PATENT DOCUMENTS

TW M346928 12/2008

* cited by examiner

*Primary Examiner* — James Harvey
(74) *Attorney, Agent, or Firm* — Wei Te Chung; Andrew C. Cheng; Ming Chieh Chang

(57) ABSTRACT

An electrical connector assembly includes an insulating housing, a plurality of first contacts received in the insulating housing, at least one detecting pin and a controlling circuitry. At least partial first contacts unitarily includes first contacting portions transferring first data signals and second contacting portions transferring second data signals. The detecting pin produces two sets of different detecting signals corresponding to the first data signals and the second data signals. The controlling circuitry controls said data signals output data signals through different output terminals.

17 Claims, 5 Drawing Sheets

ELECTRICAL CONNECTOR INCORPORATED WITH SIGNAL CONTROLLING CIRCUITRY

BACKGROUND OF THE INVENTION

1. Field of the Invention

The present invention relates to an electrical connector, and more particularly, to an electrical connector made in accordance with USB (universal serial bus) and eSATA (external serial advanced technology attachment) protocol, and incorporated with a circuitry arranged on a mother board.

2. Description of the Related Art

Taiwan Utility Patent No. M346928 issued to Taiwan Electronics Co., Ltd., discloses an electrical connector adapted for being mated with USB 2.0, USB 3.0 and eSATA plug. Four first contacts are arranged on the upper face of the tongue portion to connect with the USB 2.0 plug and seven second contacts are on the lower face of the tongue portion to connect with the eSATA plug. Middle five of said seven second contacts bent upwards and then inward from front ends thereof to form another contacting portion which cooperates with said four first contacts to connect with the USB 3.0 plug. In other word said five second contacts can transfer USB or eSATA signal depending on the insertion of the USB or eSATA plug. On the other hand, cross talking between the contacts and the trace circuits on a printed circuit where the connector is assembled will occur. Since the USB 3.0 is transmitted in a comparable high data rate, it is very much likely to create a so-called noise between the circuitry on the printed board and the contacts itself.

Hence, a new electrical connector assemble is highly desired to overcome the disadvantages of the related art.

SUMMARY OF THE INVENTION

It is an object of the present invention to provide an electrical connector made to receive plug connectors made according to USB or eSATA protocol, and detecting pin cooperating control circuitry located on motherboard so as to eliminate possible noise during transmission of data.

An electrical connector assembly comprises an insulating housing, a plurality of first contacts received in the insulating housing, at least one detecting pin and a controlling circuitry incorporated therein. At least partial the first contacts unitarily comprises first contacting portions transferring first data signals and second contacting portions transferring second data signals. The detecting pin produces two sets of different detecting signals corresponding to the first data signals and the second data signals. The controlling circuitry controls said data signals to output data signal through different output terminals.

Other advantages and novel features of the invention will become more apparent from the following detailed description of the present embodiment when taken in conjunction with the accompanying drawings.

DETAILED DESCRIPTION OF THE INVENTION

Figure 1:
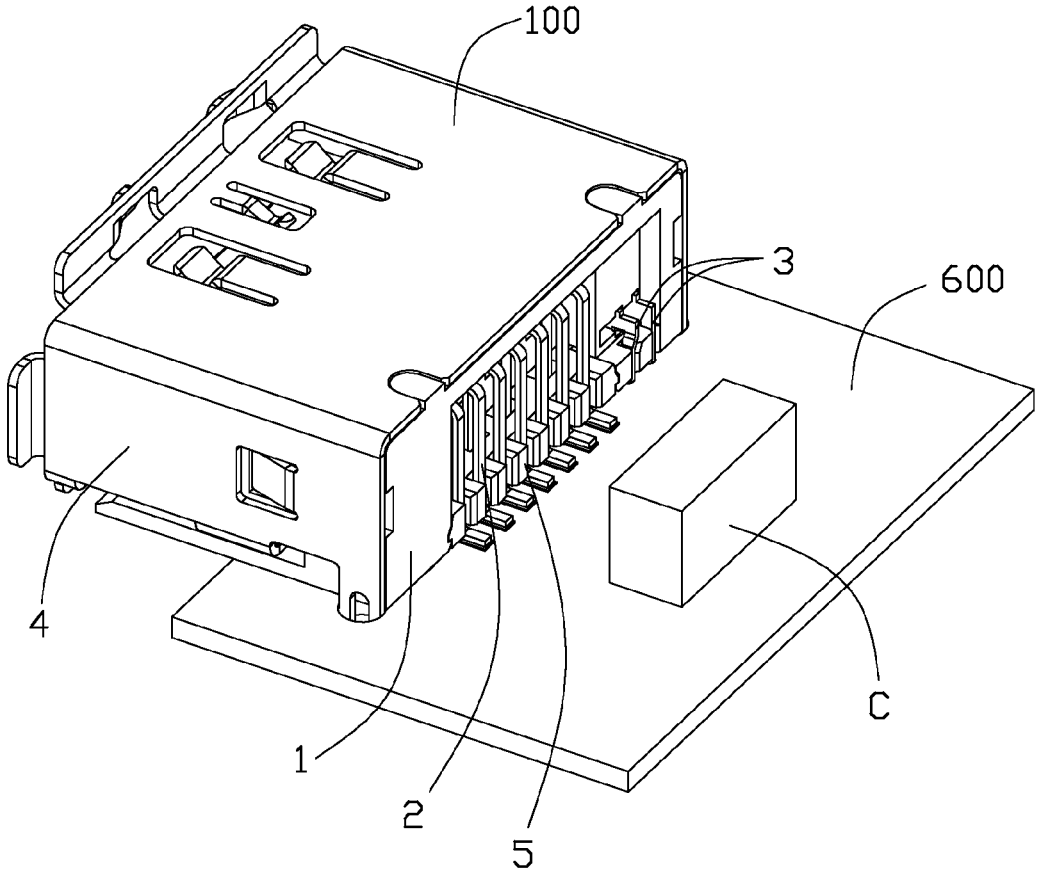
FIG. 1 is a perspective view of an electrical assembly in accordance with the present invention.

Reference will now be made to the drawing figures to describe the preferred embodiments of the present invention in detail.

Referring to FIG. 1, an electrical connector assembly made in accordance with the present invention includes an electrical connector 100, a printed circuit board (PCB) 600 mounted with the connector 100 and a controlling circuitry controlled by a control device designated as C. The electrical connector 100 is used for insertion and contact by an eSATA Plug (not shown), a USB 2.0 plug and a USB 3.0 plug (not shown) alternatively. The electrical connector assembly can distinguish the type of the inserted plug, USB or eSATA plug and shunt the data signals.

Figure 2:
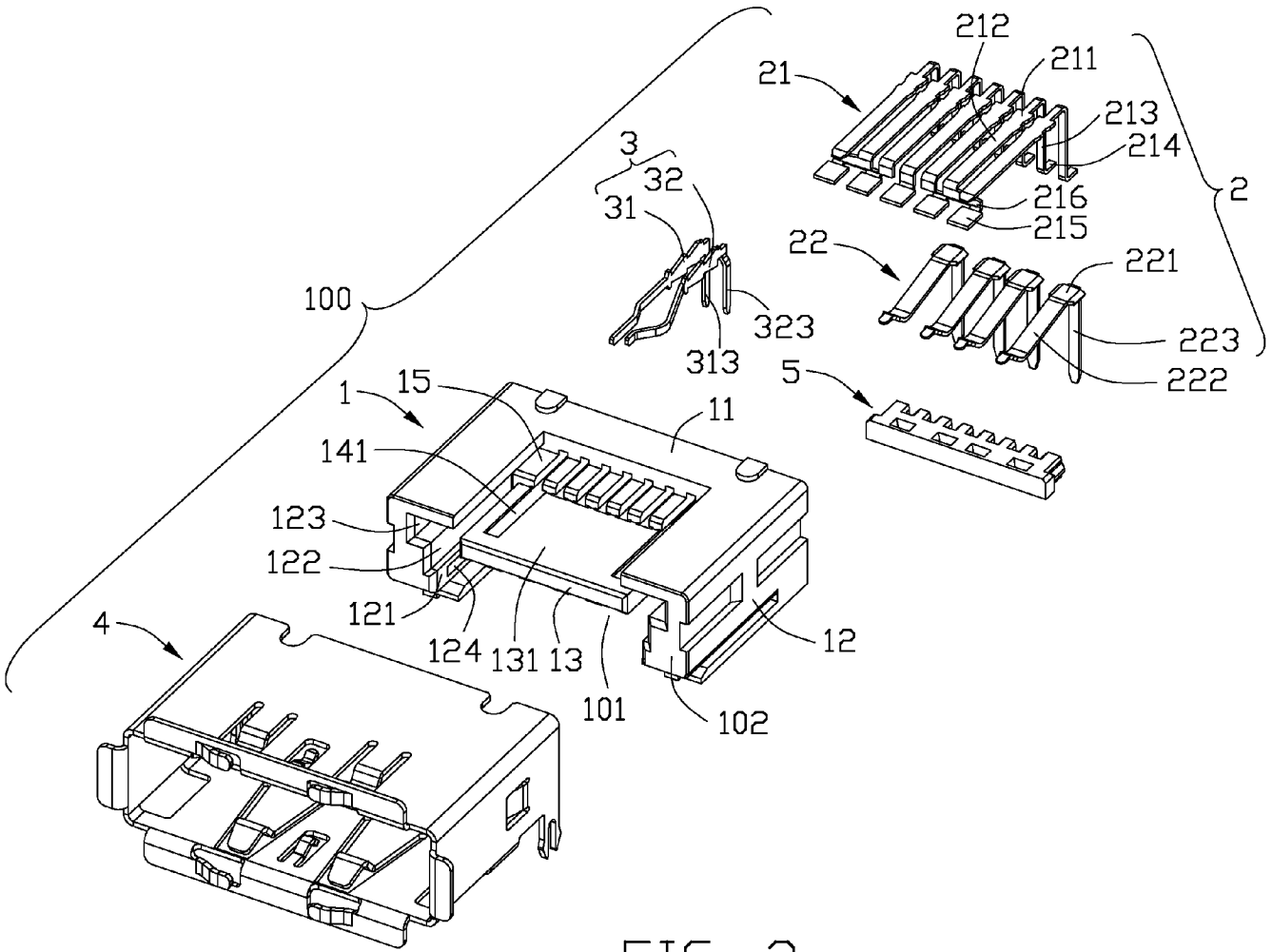
FIG. 2 is an exploded perspective view of the electrical connector.
Figure 3:
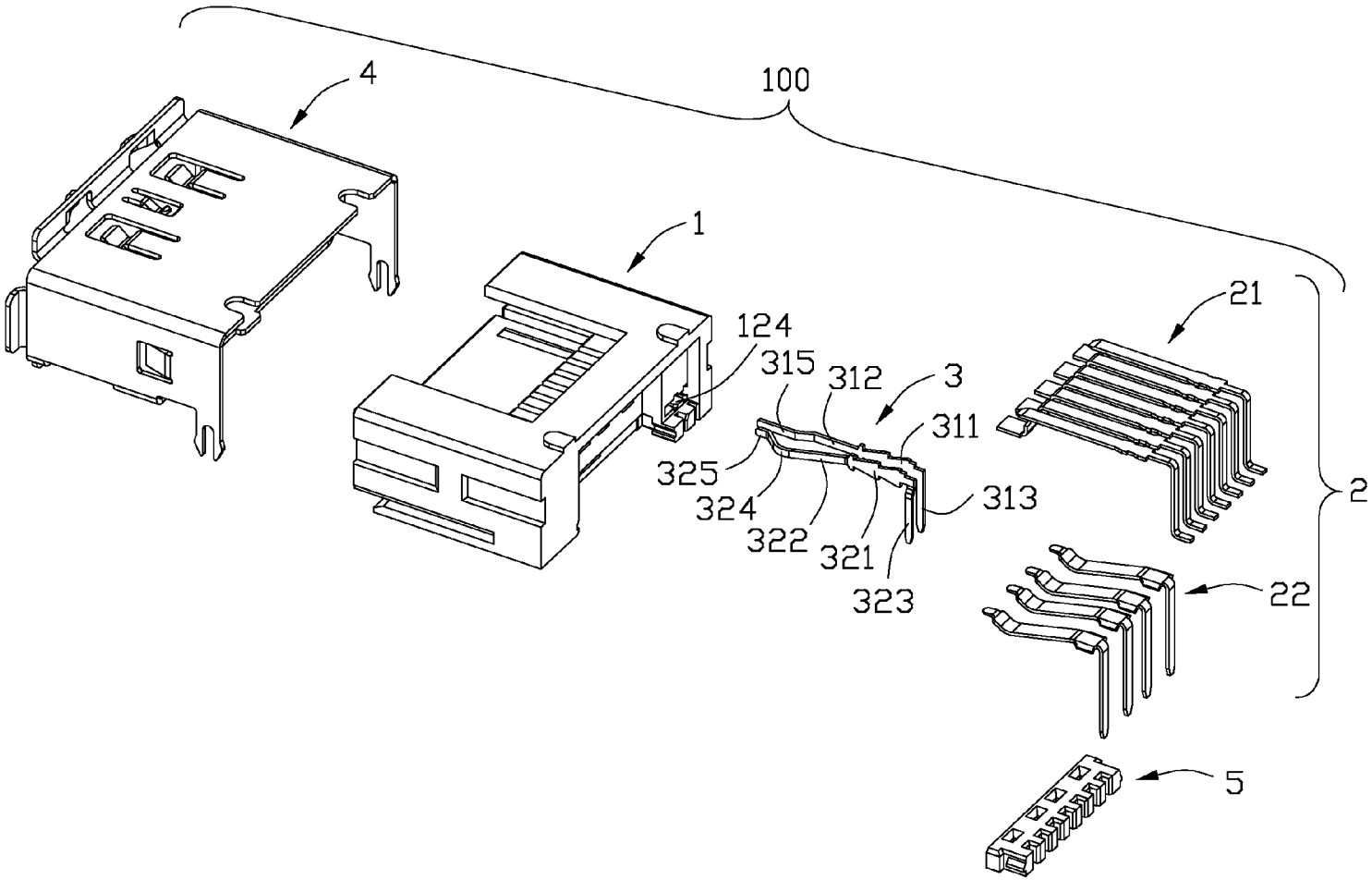
FIG. 3 is another exploded perspective view of the electrical connector.

Referring to FIG. 2 and FIG. 3, the electrical connector 100 includes an insulating housing 1, a plurality of contacts 2, a pair of detecting pins 3 and a shielding shell 4. The insulating housing 1 includes a base/base wall 11, a pair of sidewalls 12 extending forwards from two opposite ends of the base wall 11 and a tongue portion 13 extending forwards from a front face of the base wall 11. The shell 4 surrounds the housing 1 to form a mating cavity 101 among the sidewalls and base wall. The mating cavity 101 runs through a front face 102 of the housing to define a front opening from which one plug can be inserted into the mating cavity 101 and the tongue portion 13 is received in the mating cavity 101. The inside face of the sidewalls 12 is configured differential shapes with a first segment 121, a second segment 122 and a third segment 123 from lower to upper in turn. Distances between the segments and the tongue portion 13 along a direction parallel to the tongue portion 13 become larger sequentially. The first segment 121 defines a recess 124 running through the base wall 11. The tongue portion 13 has a first mating face 131 and a second mating face 132 (labeled in FIG. 4) opposite to the first mating face and a plurality of passageways 141, 142 are defined on said two mating faces respectively. An enlarged portion 15 is unitarily formed at the joints of the tongue portion 13 and the base wall 11.

Figure 4:
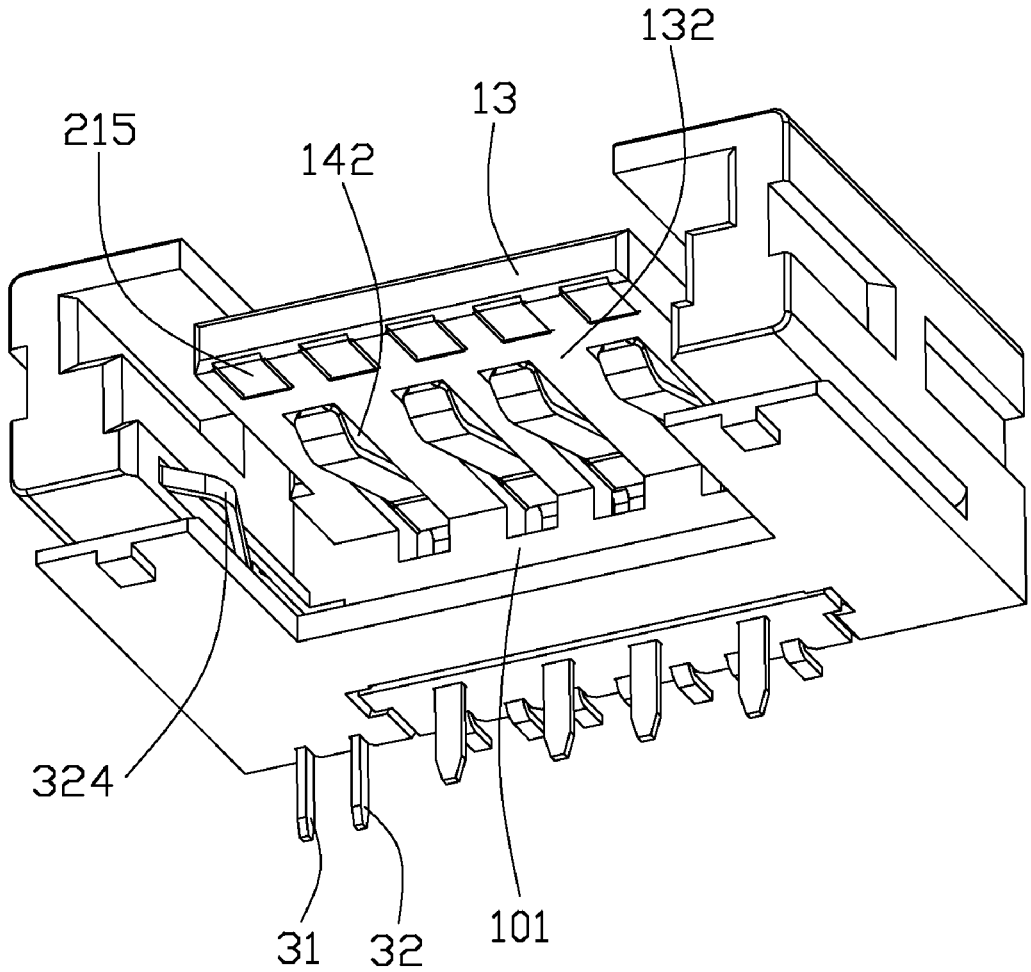
FIG. 4 is a perspective view of insulating housing with the contacts.

Referring to FIGS. 2 and 3, said plurality of contacts 2 include first contacts 21 in the first passageways 141 on the upper face 131 of the tongue portion 13 and second contacts 22 in the second passageways 142 on the lower face 132. Each of first contacts 21 with seven pins for eSATA signal transmission includes a retaining portion 211, a first plate contacting portion 212 extending forward from the retaining portion and a leg portion 213 extending downward from a rear end of the retaining portion 211. The leg portion 213 has a leveled soldering portion 214 at a free end thereof. Five of said first contacts in the middle each further include a second plate contacting portion 215 bending from a front end of the first contacting portion 212. The retaining portion 211 and the first contacting portion 212 are embedded in the upper surface 131 of the mating tongue 13, while the second contacting portion 215 bends downwards and then inwards to be embedded in the lower surface 132 as best shown in FIG. 4. The second contacting portions 215 are connecting with the first contacting portion 212 with an upright connecting portion 216. The first contacting portions 212 contact with corresponding contacts of the eSATA plug.

Each of second contacts 22 for USB signal transmission includes a retaining portion 221, an elastic contacting portion 222 extending forward from the retaining portion 221 and a leg portion 223 extending downward from a rear end of the retaining portion 221. The contacting portions 222 are located in the lower surface 132 and partially projects beyond the lower surface 132. The contacting portions 222 contact with corresponding contacts of the USB 2.0 plug. The contacting portions 222 of the second contacts 22 cooperating with the second contacting portions 215 of the first contacts contact with corresponding contacts of the USB 3.0 plug at the same time. The middle five first contacts can used as USB contacts and eSATA contacts at different time, i.e., the five middle first contacts are named as common contacts.

Referring to FIGS. 2 and 3, the pair of the detecting pins 3 having an immoveable pin 31 and a moveable pin 32, are received in the recess 124 on the first segment 121. Said two pin each comprise a retaining portion 311/321, a contacting arm 312/322 extending from a front end of the retaining portion and a solder leg portion 313/323 extending downwards from a rear end of the retaining portion. An arc portion 324 of the moveable pin 32 protrudes in the mating cavity 101 as best shown in FIG. 4. The contacting arms 312, 322 have touch portions 315, 325 at free ends thereof and contact with each other when the contact arm 322 deforms inward to the recess in response that the arc portion 324 are pressed by the plug. A contact position 5 is provided to position the through hole leg potions 223.

Figure 5:
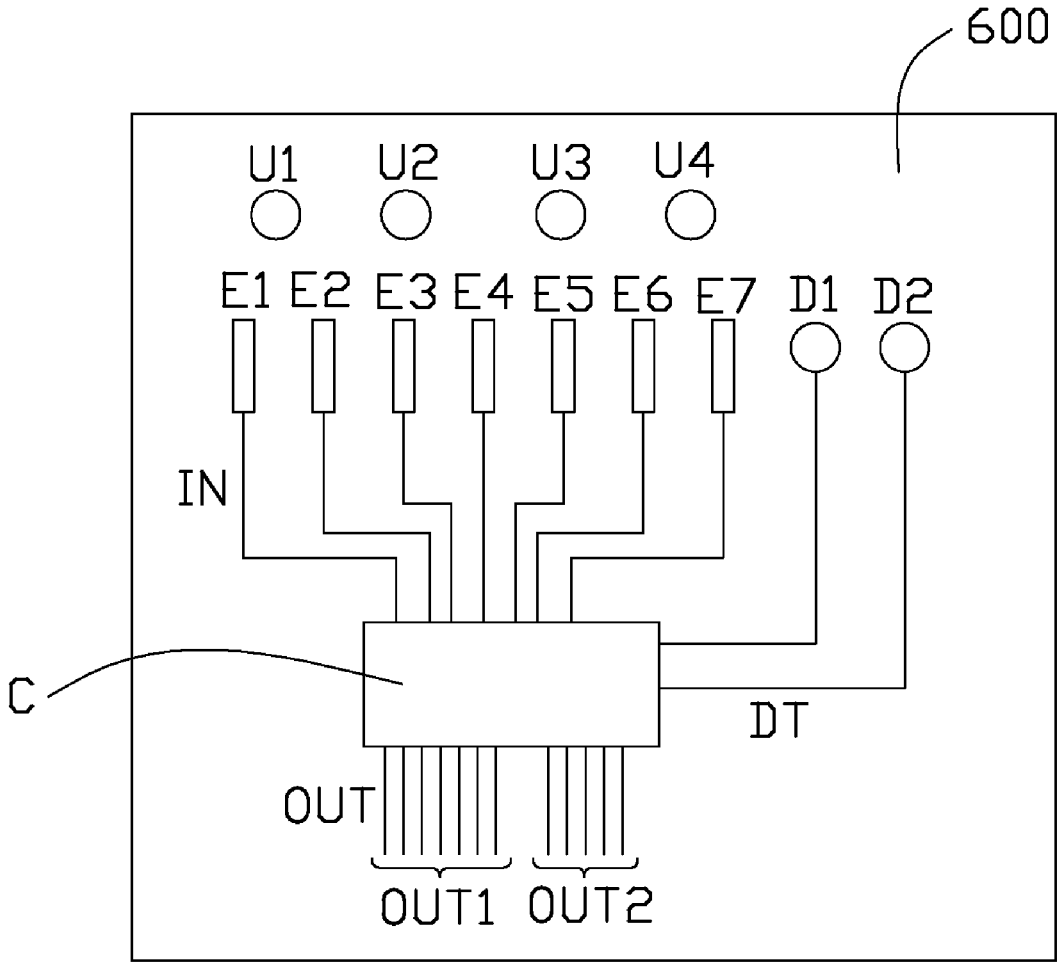
FIG. 5 is a schematic view of the controlling circuitry.

Referring FIGS. 1, 2 and 5, after the connector 100 is assembled on the PCB 600, the solder portions 214 of the first contacts are connected with the conductive pads designated as E1~E7 on the PCB with surface mount technology and the leg portion 223 of the second contacts 22 are inserted in the holes designated as U1~U4 and soldered in said holes. The leg portions 313, 323 of the detecting pins are inserted in the holes designated as D1~D2 and soldered in the holes. A plurality of circuit traces connecting with the controlling device C and the conductive pads E1~E7 are named as input circuitry designated as IN, i.e., the first contacts function as input termination of the circuitry. Two circuit traces connecting with the holes D1, D2 and controlling device C are named as a detecting circuit designated as DT. Two sets of output circuitries designated as OUT1, OUT2 corresponding the input circuit IN are connecting with the controlling device C. Said input, output and detecting circuitries commonly forms a controlling circuitry.

When the eSATA plug is inserted into the mating cavity 101, the detecting pins 3 are in the original disconnection statues since the eSATA plug is received in the second and third segments 122, 123 of the inside of the sidewalls 12. When the USB plug is inserted into the mating cavity, the detecting pins 3 are in the triggered connection statues since the USB 3.0 plug is received in the first and second segments 121, 122 of the inside of the sidewalls 12. Therefore two different input signals are produced and pass to the controlling device C through the detecting circuitry DT, and then the controlling device determines output through which set of the output circuitries. The output circuitry OUT1 with seven circuits is used for ESATA transmission and the output circuitry OUT2 with four circuits is for USB 3.0 transmission. When the eSATA plug is inserted, seven first contacts 21 are commonly work and output the data signal through the output circuitry OUT 1 while when the USB 3.0 plug is inserted, only middle five of the first contacts 21 commonly work and output data signal through the output circuitry OUT2. When the USB plug is inserted into the mating cavity, only the second contacts 22 are engaged, thus no signals transfer to the controlling device C which connects with the first contacts 21.

The controlling device C is a body chip mounted on the PCB or a virtual controlling unit by computer program. Alternatively, the detecting pins 3 can disposed on the third segment 123 to contacts with the USB plug.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an electrical connector adapted for seletably mating with a first plug and a second plug, comprising:

an insulating housing defining a mating cavity with a front opening from which said two plugs are inserted in the mating cavity respectively and a mating tongue exposing to the mating cavity, the mating tongue defining a first mating face and a second mating face opposite to the first mating face;

a plurality of contacts comprising first contacts and second contacts, the first contact comprising first contacting portions in the first mating surface, a second contacting portions in the second mating portion and leg portions, the second contacts comprising contacting portion on the second mating surface, the fist plug being mating with the first contacting portions of the first contacts while the second plug being mating with the second contacting portion of the first contacts and the contacting portion of the second contacts; and at least one detecting pin being contacted with one plug of said two plug; and a controlling circuitry comprising a controlling device, an input circuitry connecting with the controlling device and the first contacts, a detecting circuitry connecting the controlling device and the at least one detecting pin and two output circuitries corresponding to the input circuit and connecting with the controlling device;

wherein the detecting circuitry controls which one of said two output circuitries works by an insertion of one of said two plug.

2. The electrical connector assembly as described in claim 1, wherein the controlling device is defined by a body chip or virtual controlling unit by computer program.

3. The electrical connector assembly as described in claim 2, wherein the at least one detecting pin is located on the housing and exposes to the mating cavity, the controlling device is located in rear of the insulating housing.

4. The electrical connector assembly as described in claim 3, wherein the electrical connector and the controlling device are mounted on a printed circuit board, said circuitry are connected by a plurality of trace circuits printed on the printed circuit.

5. The electrical connector assembly as described in claim 1, wherein one set of said output circuitries corresponds to the first contacting portions of the first contacts and the other set of the output circuitries corresponds to the second contacting portions of the first contacts.

6. The electrical connector assembly as described in claim 5, wherein the first contacts each comprises a leg portion connecting with the trace circuit of the input circuitry.

7. The electrical connector assembly as described in claim 6, wherein partials of the first contacting portion further extend to the second mating surface to form said second contacting portions.

8. The electrical connector assembly as described in claim 1, wherein the front opening has two different outlines suitable for said two plugs, the at least detecting pin is located only on one outline of said two different outlines.

9. An electrical connector assembly comprising:

an insulating housing;

a plurality of first contacts received in the insulating housing, at least partial first contacts unitarily comprising first contacting portions transferring first data signals and second contacting portions transferring second data signals;

at least one detecting pin producing two sets of different detecting signals corresponding to the first data signals and the second data signals; and a controlling circuitry controlling said data signals output data signals through different output terminals.

10. An electrical connector assembly for use different first and second complementary connectors, comprising:

an insulative housing defining a mating port;

a plurality of contacts disposed in the housing, each of said contacts defining a first contacting section, for mating with said first complementary connector, and a second contacting section, for mating with said second complementary connector, at different positions thereof;

a detecting terminal set positioned around the mating port and actuated differently by said first complementary connector and said second complementary connector; and a set of controlling circuits linked to the contacts and defining first and second sets of output circuits which are mutually exclusively activated corresponding to operation of said first contacting sections and said second contacting sections, respectively; wherein said set of controlling circuit is further linked to the detecting terminal set to determine the corresponding one of said first and second sets of output circuits works according to the corresponding one of the first and second complementary connectors being received in the mating port to mate with the corresponding one of the first contacting sections and the second contacting sections.

11. The electrical connector assembly as claimed in claim 10, wherein said detecting terminal set is located at a specific level in the mating port, under condition that the first complementary connector is not located at said specific level during mating and can not actuate the detecting terminal set while the second complementary connector is located at said specific level during mating and can actuate the detecting terminal set.

12. The electrical connector assembly as claimed in claim 11, wherein said first contacts further include additional ones having the first contacting sections while without the second contacting sections.

13. The electrical connector assembly as claimed in claim 11, wherein the first contacting sections and the second contacting sections are located at tow different levels.

14. The electrical connector assembly as claimed in claim 13, wherein said two different levels are different from said specific level.

15. The electrical connector assembly as claimed in claim 10, wherein a mating tongue with opposite first and second faces thereon, extends in the mating port and the first contacting sections and the second contacting sections are respectively located on said opposite first and second faces, respectively.

16. The electrical connector assembly as claimed in claim 15, further including a plurality of second contacts having contacting portions on the second face and offset from said second contacting sections in a front-to-back direction.

17. The electrical connector assembly as claimed in claim 16, wherein said second contacts perform respective output circuits without involvement with the set of controlling circuit.

* * * * *